United States Patent [19]

Scott et al.

[11] 4,272,333

[45] Jun. 9, 1981

[54] MOVING BED ELECTROLYSIS

[75] Inventors: Keith Scott, Stockton-on-Tee; Allen R. Wright, Wallsend, both of England

[73] Assignee: National Research Development Corporation, London, England

[21] Appl. No.: 127,245

[22] Filed: Mar. 4, 1980

[30] Foreign Application Priority Data

Mar. 7, 1979 [GB] United Kingdom ..... 08039/79
Nov. 21, 1979 [GB] United Kingdom ..... 40284/79

[51] Int. Cl.[3] ..... C25D 5/04; C25D 17/12; C25C 1/00; C25C 7/02

[52] U.S. Cl. ..... 204/23; 204/105 R; 204/222; 204/275

[58] Field of Search ..... 204/23, 105 R, 108, 204/222, 275, 105 M, 112, 114, 120

[56] References Cited

U.S. PATENT DOCUMENTS

| | | | |
|---|---|---|---|
| 1,789,443 | 1/1931 | Levin | 204/20 |
| 3,787,293 | 1/1974 | Kametani | 204/108 |
| 3,974,049 | 8/1976 | James | 204/222 |
| 4,019,968 | 4/1977 | Spaziante | 204/23 |
| 4,039,402 | 8/1977 | LeRoy | 204/105 R |
| 4,171,249 | 10/1979 | Newton | 204/105 R |

FOREIGN PATENT DOCUMENTS 2437273 2/1975 Fed. Rep. of Germany .

OTHER PUBLICATIONS

Electrochimica Acta, 1977, vol. 22, pp. 1073–1076.

*Primary Examiner*—T. M. Tufariello
*Attorney, Agent, or Firm*—Oblon, Fisher, Spivak, McClelland & Maier

[57] ABSTRACT

A method of moving bed electrolysis, in which a packed bed comprising (at least superficially) conductive particles moves as a packed bed in electrolyte between two electrodes and in electronic contact with one of them, the particles emerging from the downstream end of the moving packed bed being transported, outside the electric field between the two electrodes, to a location from which they rejoin the moving packed bed at its upstream end or join the upstream end of a succeeding moving packed bed between two electrodes.

14 Claims, 9 Drawing Figures

Figure 1:
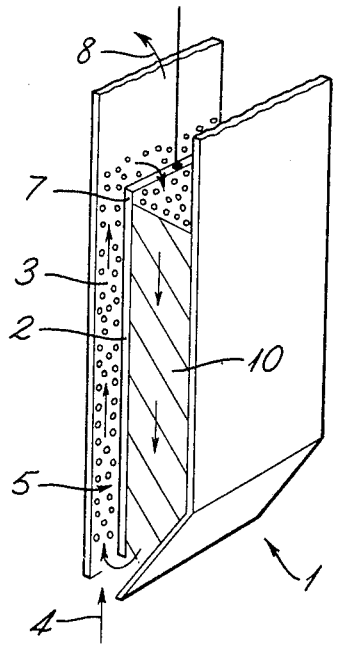

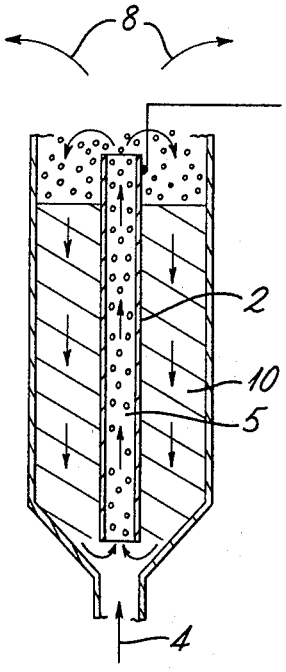
Fig. 2a
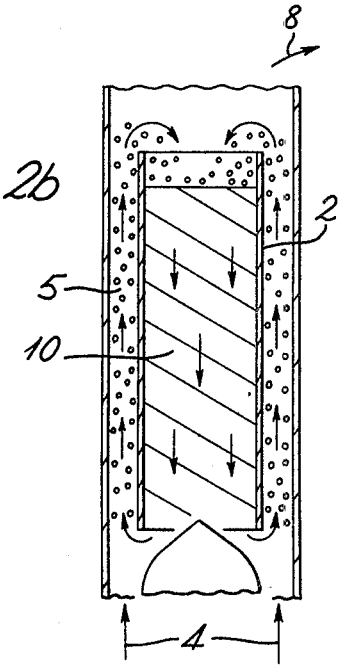
Fig. 2b
Fig. 2c
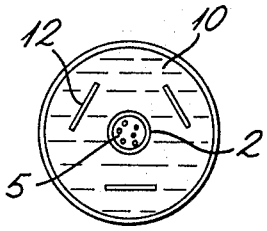

MOVING BED ELECTROLYSIS

This invention relates to a method of moving bed electrolysis.

Particles can conveniently be electrolysed by packing them into a vessel containing liquid electrolyte and applying a potential across opposite faces of the packed bed of particles. In the case where the cathode is in electronic contact with the packed bed, deposition of metal on to the particles may cause the whole bed to agglomerate into an awkward mass. Although porous electrodes overcome this problem, they have short lives. To fluidise the bed, in accordance with U.K. Pat. No. 1,194,181, also overcomes the agglomeration problem but is not successful with certain metals, such as manganese.

The present invention consists of a method of moving bed electrolysis, in which a packed bed comprising (at least superficially) conductive particles moves as a packed bed in electrolyte between two electrodes and in electronic contact with one of them, the particles emerging from the downstream end of the moving packed bed being transported, outside the electric field between the two electrodes, to a location from which they rejoin the moving packed bed at its upstream end or join the upstream end of a succeeding moving packed bed between two electrodes.

The moving packed bed may move upwardly, as set forth e.g. in Leung, Wiles and Nicklin, Transactions of the Institution of Chemical Engineers, 47 1969 pp. T271-278.

The preferred form of the present invention however consists of a method of moving bed electrolysis, in which a packed bed comprising (at least superficially) conductive particles moves downwards (in a 'falling region') between two electrodes and in electronic contact with one of them, and (preferably by introducing upwardly flowing electrolyte adjacent the bottom of the moving packed bed (in a 'levitation region')) the particles emerging from the bottom of the moving packed bed are levitated, outside the electric field between the two electrodes, to a level above the top of the moving packed bed, or of a succeeding packed bed, whereafter the particles drop into the space between the electrodes to rejoin or join the moving packed bed.

It will be appreciated that (except in the case of successive packed beds) the particles are in the preferred case constantly recirculated, and fractions of particles can easily be removed, and fresh particles added, without disrupting the electrolysis and without unduly upsetting the homogeneity of the packed bed.

As the 'falling region' and the 'levitation region' may be side-by-side, if they are both cuboidal, any number of such regions may be arranged alternately. Alternatively one region may be upright cylindrical and the other annular, disposed about the first region. To ensure that the levitation region is outside the electric field between the two electrodes, it is convenient to have the moving packed bed constrained in all horizontal directions by rigid structure, which may include a diaphragm protecting the counterelectrode (i.e. the electrode which is not the one with which the bed is in electronic contact). Thus, the levitation region would be behind or beyond the rigid structure, preferably within the influence only of the feeder working electrode.

In this way, the levitated particles convey negligible current. This prevents any unwanted effects which might arise, such as passivation, oxidation or bipolarity. The particles are only in the electric field (the current field) when they are in the moving packed bed, i.e. only when they are in electronic contact with the electrode. When they are being levitated in the preferred arrangement, the particles are by contrast within the influence only of the feeder working electrode, which tends to protect them cathodically in one preferred mode.

The feeder working electrode which may thus (protected on one side by a diaphragm) separate the falling region from the levitation region may be flat or cylindrical or may have a complex structure, such as an upright plate or cylinder having vertical projecting fins, possibly to improve current distribution to the particles. Measures may be adopted for ensuring electrolyte replenishment in the moving bed.

This method may be used to deposit metals (including some of the more readily soluble ones), such as manganese, tin, zinc and cobalt, from solution, and to treat effluent and to perform organis syntheses. The deposition of zinc may form the recharging step in the use of rechargeable zinc-air/halogen batteries.

The apparatus for performing the method may, moreover, be used for a complete (e.g. zinc-air/halogen) battery system which could be electrically, or mechanically, rechargeable. The charging and discharging may be operated at different rates of particle circulation. Discharging may be performed with minimal or no particle circulation, to increase power output.

As will be explained, a physical barrier separating the falling region from the levitation region is not essential.

In many of the arrangements conforming to the invention set forth above, upwardly flowing electrolyte is introduced adjacent the bottom of the moving packed bed and serves to sustain the levitation region. However, even with careful design of the electrolyte inlet, the electrolyte will generally tend to flow upwardly in also the falling region. The flow will be inadequate to levitate the conductive particles comprising the moving packed bed in the falling region, but, being countercurrent to the bed, will nonetheless tend to impede the particles' downward movement, thus limiting the 'fall rate' of the bed.

Therefore, in one mode according to the invention, an electrolyte outlet is provided generally in the vicinity of the moving packed bed such as to permit electrolyte to flow co-current with the moving packed bed.

The electrolyte is preferably introduced into the electrolysis generally adjacent or downstream (as regards the particles) from an electrolyte outlet so that the electrolyte passes through the moving packed bed region. This encourages the electrolyte to follow the sense of the particles, in particular to 'fall' in the falling region. This gives the electrolyte more time in contact with the particles of the moving bed, as it is now flowing cocurrent therewith, and may allow 'single pass' treatment of the electrolyte.

The electrode separating the falling and levitation regions may alternatively be disposed wholly within the falling region, preferably with apertures allowing electrolyte, and more preferably also allowing particles, to pass therethrough.

Figure 3:
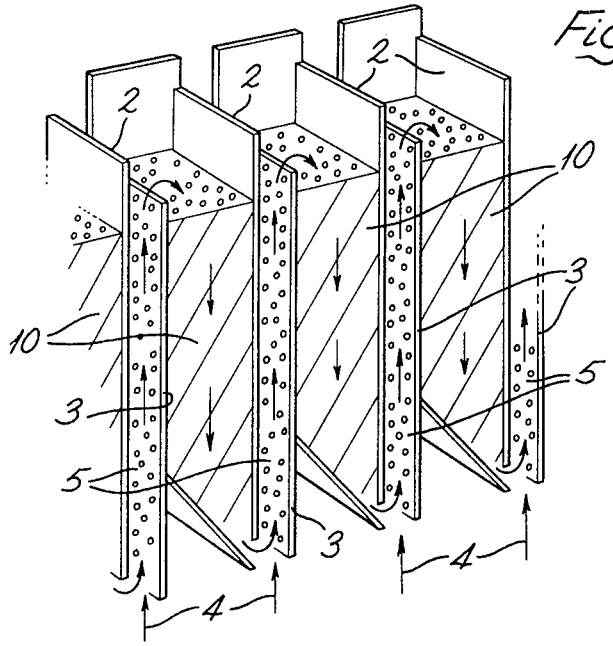
Figure 4:
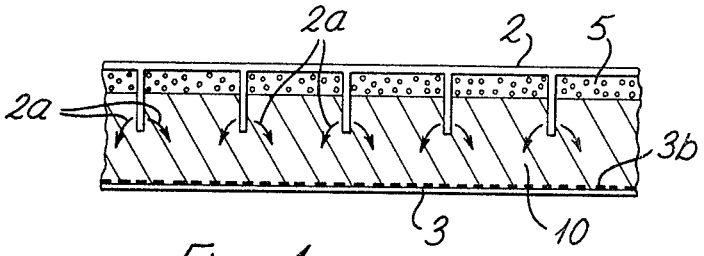
Figure 5:
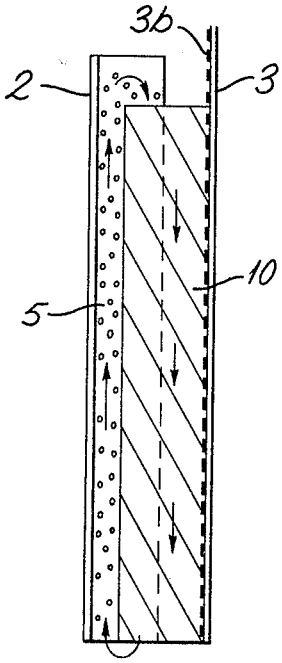
Figure 6:
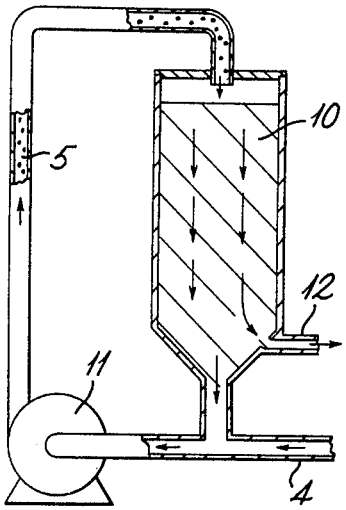
Figure 7:
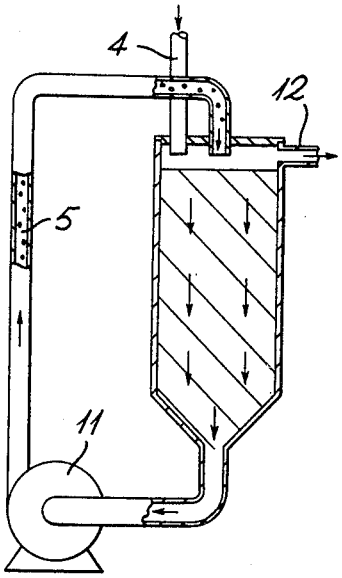
Figure 8:
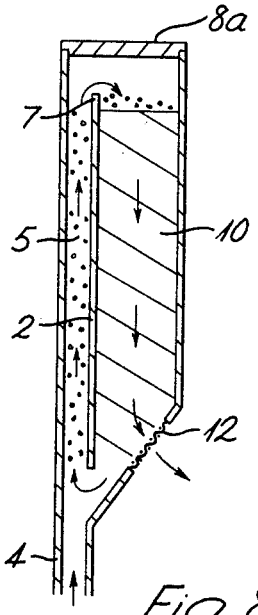
Figure 9:
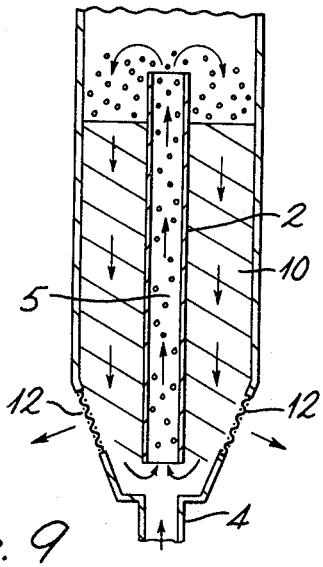

Cells for performing the method will now be described by way of example with reference to the accompanying drawings, in which:

FIG. 1 is a diagrammatic cross-section of a cell for moving packed-bed electrolysis, FIGS. 2*a* and 2*b* are cross-sections of cylindrical cells, FIG. 2*c* is a plan view of the cell of FIG. 2*a*, FIG. 3 shows a battery consisting of an assembly of cells similar to the cell of FIG. 1, FIG. 4 is a plan view of a cell with a finned electrode, FIG. 5 is a vertical cross-section of the cell of FIG. 4, FIGS. 6 and 7 are diagrammatic cross-sections of cells according to the invention with alternative electrolyte routes, FIG. 8 shows a cell similar to that of FIG. 1 but modified as to electrolyte route, and FIG. 9 shows a cell similar to that of FIG. 2*a* but likewise modified as to electrolyte route.

Turning to FIG. 1, electrolyte is pumped upwardly into a cell 1 to the left (as drawn) of a vertical electrode 2 which forms a partition and which may, but need not, have an insulating coating on its left-hand face. Conductive particles 3 are levitated by the upwards flow 4 of the electrolyte, in what may be regarded as a levitation region 5. The electrolyte fills the cell 1. As the particles 3 pass the top edge 7 of the electrode 2, the electrolyte flows off at 8 and the particles 3 drop into what may be regarded as a falling region 10. The electrolyte flowing off at 8 may be recirculated to 4. The falling region 10 consists of a moving packed bed of the conductive particles 3 bounded on one side by the electrode 2 and on the other by walls of a cell or a diaphragm or the like, behind which a counterelectrode (not shown) is disposed.

This has the advantage over the fluidised bed electrode that only the relatively gently moving particles in the packed bed—as opposed to vigorously moving fluidised particles—contact the diaphragm, which should extend the life of the diaphragm.

The electrode 2 (if the cathode) may form a stainless steel duct, open top and bottom, around the levitation region 5, affording that region a measure of cathodic protection, so that the levitated particles are inhibited from dissolving. It is separated from the anode compartment by a cationic semi-permeable membrane diaphragm of 100 $cm^2$. With this modification, this cell is referred to, in the following Experiments, as 'FIG. 1(mod)'.

The moving bed falls as a whole, with individual particles being substantially continuously in electronic contact with the rest of the moving bed until they reach the bottom of the electrode 2. When emerging underneath that bottom, they are again levitated behind the electrode 2 to the top edge 7 by the flow of electrolyte, outside the electric field between the electrodes 2 and the counterelectrodes, and recirculate in this fashion until consumed or removed. Note that in an alternative arrangement, the electrode 2 may be replaced by an inert partition, for example of plastics material. Anode and cathode (one of which is protected by a diaphragm permeable to the electrolyte and not to the particles) are above and below the plane of the paper.

The FIG. 1 cell may advantageously be tilted in operation by about 20° anticlockwise as drawn, so that the packed bed in the falling region 10 is slightly resting against the electrode 2.

The distance between the electrode 2 and the right-hand face of the falling region 10 may be 2 cm, the effective height of the electrode 2 may be 14.5 cm and its breadth may be 4.5 cm.

The cell is provided with catholyte and anolyte inlets at the bottom and corresponding outlets at the top.

In FIG. 2, the principle of operation is as in FIG. 1, but the falling and levitation regions are of different form. In FIG. 2*a*, a vertical electrode 2 in the shape of a hollow stainless steel tube 2.5 cm in diameter and 25 cm high forms a partition bounding an inner levitation region 5 from an outer annular falling region 10. In FIG. 2*b*, a vertical electrode 2 in the shape of a hollow tube forms a partition bounding an inner falling region 10 from an outer annular region 5. A counterelectrode (not shown) protected by a diaphragm (e.g. a cloth wrapped round the counterelectrode) pokes into the falling region 10. In FIGS. 2*a* and 2*b*, the upward electrolyte flow 4 is so guided as to provide the levitation where it is wanted, and after having traversed the levitation region, the electrolyte flows off at 8. FIG. 2*c* is a cross-sectional plan of the cell of FIG. 2*a*. The electrode 2 may be a stainless steel cathode with three sheet counterelectrodes 12 (60 $cm^2$ each, thin strips of platinised titanium) disposed in the falling region 10, the outer faces of the anodes 12 being protected from the cathodic (falling) region 10 by diaphragms. Electrical power is supplied by conventional leads to the top of each electrode.

In FIG. 3, a battery of cells similar to FIG. 1 is arranged side-by-side, with electrodes 2 (cathodes in this Figure) interconnected by a busbar arrangement separating levitation regions 5 from falling regions 10. The particles in the levitation regions 5 may enjoy cathodic protection, with a cathode present on one side; the particles are not in any cathode-anode current field. An anode 3 insulated on the lefthand side (as shown in FIG. 3) and protected by a diaphragm on its righhand side (insulation and protection omitted for clarity) projects into each of the falling regions 10. In an alternative arrangement, the cathodes are parallel to the 'back' of the Figure, and form the 'behind' boundaries of the cells, while the anodes are parallel to the cathodes but 'in front', bounding the falling regions 10 and being protected by diaphragms. Appropriate inlets are provided for the upward electrolyte flow 4 under each levitation region 5. As will be seen, each falling region 10 leads in series to the next levitation region 5. Each electrolyte inlet 4 may thus be arranged in accordance with the particle sizes in its respective region, taking account of the progressive growth of the particles. Alternatively, the cells may be independent. Another modification to the cell of FIG. 3 is that only the first (lefthand as drawn) inlet for electrolyte flow 4 is provided. This will constrain the electrolyte to flow co-current with the particles not only in the levitation region 5 but also downwards in the following falling region 10, at the base of which a pump (not shown) levitates the electrolyte and emerging particles into the next levitation region 5. A similar pump is provided adjacent the base of also each subsequent levitation region 5. If the relative sizes of the regions 5 and 10 are suitable, and the passageways joining the base of the falling region 10 with the succeeding levitation region 5 are suitably shaped, then a single pump may suffice to ensure passage of the electrolyte and particles through the whole series of cells in FIG. 3.

With the above modification, it is suitable to fasten an insulating lid (not shown) on the top edges of the electrodes 2 to prevent overflow of electrolyte.

FIG. 4 is a plan view of a cell similar in principle to that of FIG. 1, but with a finned electrode 2. The electrode 2 has an upright plate at one face of the levitation region 5, the plate carrying vertical fins which project through the levitation region into the falling region 10. The plate and fins may be covered with an insulating coating within the levitation region, with bare metal exposed in the falling region (packed bed) only, but this is not essential. Current flows from the electrode 2 as shown at 2*a*. The counterelectrode 3 is protected by a diaphragm or screen 3*b*. FIG. 5 is a vertical cross-section of the cell of FIG. 4. The reason for using a finned cathode (or anode, for an anodic reaction) is that no physical barrier is absolutely necessary between the falling and rising phases, provided electronic contact is made between the current feeder and the moving bed, and provided further that no particle is in the anode-cathode current field unless it is in electronic contact with the current feeder. Particles in the levitation region are effectively not, it will be observed, in the anode-cathode current field. The electrolyte inlet arrangements for the cell of FIGS. 4 and 5 may be generally as shown in FIG. 1. Electrolyte may be allowed to leave the cell over the top lip of the electrode 2 (FIG. 5), whereby the electrolyte flow in the moving packed bed will be upwards and therefore countercurrent to the particles. Alternatively, an electrolyte outlet may be provided in the side of the moving bed falling region 10. In this way, rising electrolyte will levitate the particles in the levitation region 5 and will continue to flow co-current with them through the packed bed in the falling region 10 until the electrolyte reaches its outlet. A certain amount of mixing of the electrolyte (not to mention of the particles) will take place between the levitation region 5 and the falling region 10.

Turning now to FIG. 6, a cell is shown schematically, drawing attention to the electrolyte route. The inlet for electrolyte flow 4 is situated between the bottom of the falling region 10 and a pump 11 for levitating the electrolyte and particles in the levitation region 5. The falling region 10 is arranged between two electrodes (not shown), one in electronic contact with the moving packed bed and the other protected by a diaphragm.

Levitated particles emerging from the top of the region 5, and the electrolyte accompanying them, are ducted to the falling region 10, near the bottom of which an outlet 12 allows electrolyte, but not particles, to leave the circuit. This electrolyte route permits the electrolyte to flow co-current with the particles not only during levitation, as in FIGS. 1–5, but also when they are in the moving packed bed.

FIG. 7 shows an alternative arrangement permitting the electrolyte to flow co-current with the particles as in FIG. 6. The levitation region 5, the pump 11 and the falling region 10 are as in FIG. 6, but the inlet for electrolyte flow 4 is now disposed at the top of the falling region 10 and adjacent the electrolyte outlet, overflow 12.

FIG. 8 shows a cell similar to that of FIG. 1, modified in that a grille 12 is provided to allow electrolyte (but not particles) to leave the cell above the inlet for levitating electrolyte flow 4. This grille causes the electrolyte in the falling region 10 to fall co-current with the particles.

In FIG. 1, electrolyte overflows upwardly at 8, but in FIG. 8, a lid 8*a* prevents this and constrains electrolyte after passing the top edge 7 of the electrode 2 to flow downwardly with the particles in the moving packed bed at 10.

FIG. 9 shows a cell similar to that of FIG. 2*a*, modified as is FIG. 8 with a grille 12 above the inlet for levitating electrolyte flow 4, with similar effects in causing the electrolyte even in the falling region 10 to fall co-current with the particles.

The materials for constructing the above cells may be as follows. The anode 3 (or 12 for cylindrical arrangements as in FIG. 2*c*) may be of nickel or of titanium coated with ruthenium dioxide. The diaphragm may be an ion-exchange membrane, supported mechanically as necessary, for example by an apertured plate over which the diaphragm is held. Alternatively the anode 3 (or 12) may be platinised titanium covered with (as a diaphragm) 95 μm plastics gauze. The cathode may be an upright stainless steel tube surrounding the levitation region 5 (especially in the FIG. 2*a* embodiment, where there are the three anodes 12 of platinised titanium, each protected by plastics mesh). The conductive particles are chosen to suit the reaction, and may typically be acid-cleaned and rinsed copper particles of particle diameters passing through an 810 μm sieve but not through a 600 μm sieve. For tin deposition from acid solution the particle size was preferred to be 1–2 mm.

The cells according to the invention were used in the following experiments, which were all batch electrolyses where solutions are electrolysed for a certain length of time and the changes in concentration of the species investigated were used to estimate current efficiencies.

The bed fall rate, which could affect the mass transfer rate, was (to avoid complication) maintained approximately constant at about 1 cm/sec.

EXPERIMENT 1

Acid Copper Deposition

The cell of FIG. 1 was charged with 1 M $H_2SO_4$ and $Cu^{++}$ at 2.5 g/l. The results for depositions at varying cell currents and solution concentration are given in Table I.

It can be seen that good current efficiencies (greater than 60%) and low energy consumptions (1.8 to 3.6 kWh/kg) are obtained. The particulate bed did not agglomerate and the diaphragm did not scale or foul during operation.

TABLE I

| Cell Current (Amps) | Cell Voltage (V) | Coulombs ($\times 10^{-5}$) | Solution Concn. (g/l) | Current Efficiency Cumulative | Overall Energy Consumption (kWh/kg) |
|---|---|---|---|---|---|
| 12 | 3.5 | — | 5.6 | — | — |
| | | 0.56 | 2.67 | 85% | 3.6 |
| 5 | 2.5 | — | 1.68 | — | — |
| | | 0.18 | 0.71 | 84% | — |
| | | 0.294 | 0.26 | 76% | — |
| | | 0.363 | 0.13 | 65% | — |
| | | 0.423 | 0.02 | 61% | 3.58 |
| 4 | 2.1 | — | 2.0 | — | — |
| | | 0.1152 | 1.3 | 83% | — |
| | | 0.274 | 0.45 | 77.5% | — |
| | | 0.35 | 0.24 | 66% | 2.78 |
| 4 | 2.1 | — | 1.7 | — | — |
| | | 0.305 | 0.325 | 74% | — |
| | | 0.377 | 0.13 | 64% | 2.8 |
| 2 | 1.55 | — | 2.38 | — | — |
| | | 0.394 | 0.19 | 76.5% | — |
| | | 0.422 | 0.05 | 75.5% | 1.8 |

EXPERIMENT 2

Acid Copper Deposition

The results for depositions from molar $H_2SO_4$ at varying cell currents are given in Table II, for a cell according to FIG. 1 in which the diaphragm is fine (95

μm) plastics gauze supported by a 75 $cm^2$ platinised titanium anode. High current efficiencies at low energy consumptions were achieved in some ranges.

TABLE II

| Cell Current (Amps) | Average Cell Voltage (Volts) | Coulombs ($\times 10^{-5}$) | Solution Conc. (g/l) | Current Efficiency (%) | Overall Energy Consumption (kWh/kg) |
|---|---|---|---|---|---|
| 8 | 2.3 | — | 1.58 | — | — |
| | | .047 | 1.27 | 99 | — |
| | | .099 | 0.95 | 96 | — |
| | | .212 | 0.292 | 92.5 | — |
| | | .26 | 0.172 | 82.5 | 2.44 |
| 4 | 2.05 | — | 1.29 | — | — |
| | | .04 | 1.03 | 99 | — |
| | | .146 | 0.375 | 95 | — |
| | | .191 | 0.14 | 94 | 1.91 |
| 2 | 1.83 | — | 0.98 | — | — |
| | | .072 | 0.49 | 100 | — |
| | | .105 | 0.305 | 97 | — |
| | | .137 | 0.114 | 96 | 1.67 |
| 4 | 2.2 | — | 0.3 | — | — |
| | | .035 | 0.156 | 67 | — |
| | | .104 | 0.03 | 42 | 4.58 |

EXPERIMENT 3

Acid Copper Deposition

The results for depositions from molar $H_2SO_4$ containing 1 g/l copper in the cell of FIG. 2*a* at varying cell currents are given in Table III.

TABLE III

| Cell Current (A) | Average Cell Voltage (V) | Solution Concn. (g/l) | Current Efficiency (%) | Overall Energy Consumption (kWh/kg) |
|---|---|---|---|---|
| 10 | 2.2 | 1.255 | — | — |
| | | 0.021 | 60.5 | 3.18 |
| 20 | 2.45 | 0.831 | — | — |
| | | 0.33 | 84 | — |
| | | 0.076 | 67.5 | 3.17 |
| 30 | 3.0 | 0.813 | — | — |
| | | 0.292 | 81 | — |
| | | 0.063 | 65 | 4.03 |
| 40 | 3.2 | 0.857 | — | — |
| | | 0.362 | 84.5 | — |
| | | 0.12 | 63.5 | 4.4 |

Current efficiencies of over 60% for the deposition of copper are obtained. The results however are slightly inferior to the previous results. This is probably due to an increase in copper dissolution resulting from the presence of dissolved oxygen, as in this cell a much larger volume of bed to diaphragm area is used.

EXPERIMENT 4

Acid Copper Deposition

The cell of FIG. 4 was used with molar $H_2SO_4$. A typical run with this finned cathode arrangement gave a current efficiency of 67.5% for a change in copper concentration of 1.4 to 0.16 g/l at a cell current of 30 amps and an average cell voltage of 2.4 volts. The energy consumption of this electrolysis was 3.1 kWh/kg. No significant deposition of copper on the cathode structure occurred.

EXPERIMENT 5

Acid Tin Deposition

The results for the deposition of tin ($Sn^{2+}$) at varying cell currents using the cell of FIG. 1 are given in Table IV. The particle size in these electrolyses was 1.2–2 mm (sieved). The electrolyte was stannous sulphate (0.2–1 g/l in tin) in 1 M $H_2SO_4$ at 30° C.

In these runs a light adherent tin deposit was obtained, without the occurrence of particle agglomeration or diaphragm scaling. The results show that high current efficiencies (up to 100%) for tin deposition can be obtained if the cell current (or current density) is of the order of 1 to 4 amps (300–1200 A/$m^2$).

The tin deposition was affected by the presence of stannic ($Sn^{4+}$) ions from the technical grade feedstock. This is a possible source of inefficiency in the electrolysis at low stannous ($Sn^{2+}$) ion concentrations, due to the reduction of stannic to stannous represented by the reaction $$Sn^{4+} + 2e \rightarrow Sn^{2+}.$$

TABLE IV

| Cell Current (Amps) | Average Cell Voltage (V) | Solution Concn. (p.p.m.) | Current Efficiency (%) | Overall Energy Consumption (kWh/kg) |
|---|---|---|---|---|
| 10 | 4.15 | 477 | — | — |
| | | 172 | 37 | 5 |
| | | 24 | 27.5 | 6.8 |
| | | 2 | 22 | 8.4 |
| 6 | 3.0 | 306 | — | — |
| | | 10.4 | 35 | 3.91 |
| | | 1.2 | 18 | 7.6 |
| 4 | 2.5 | 950 | — | — |
| | | 562 | 100 | — |
| | | 283 | 86 | 1.36 |

EXPERIMENT 6

Neutral Copper Deposition

For the electrolysis of a 1.8 g/l copper sulphate solution in the cell of FIG. 1, a cell current of 2 amps was used. The concentration of copper was reduced from 1.8 g/l to 0.095 g/l with an overall current efficiency of 40% at an average cell voltage of 2.05 volts. The energy consumption was 4.48 kWh/kg.

EXPERIMENT 7

Zinc in Alkali Deposition

The cell of FIG. 1 was charged with 2 M KOH electrolyte. Zinc was deposited from a solution containing 3.4 g/l $Zn^{2+}$ as oxide at a cell current of 10 amps (current density 3,000 A/$m^2$) and a cell voltage of 4.7 volts. A current efficiency of 90% was achieved on reducing the zinc concentration to 2 g/l.

EXPERIMENT 8

Experiment 7 was repeated, but in the cell of Experiment 2, as a result of which the current density was 3,330 A/$m^2$ based on the active anode area. A current efficiency of 88% was achieved at a cell voltage of only 3.13 volts. This voltage was significantly less than the above case due to the absence of a cation exchange membrane and a separate anolyte solution.

Even for high current densities (7,000 A/$m^2$), only 4 V are needed, this being somewhat lower than with diaphragmless fluidised beds for the same electrolytic system.

EXPERIMENT 9

Zinc in Alkali Deposition

Experiment 7 was repeated, but with 6 M KOH electrolyte. The cell however was according to FIG. 1 (mod), in which furthermore the righthand face of the falling region 10 was bounded not by a diaphragm (held by a support just clear of a planar anode further to the right) but by a nickel anode plate protected from the particles by a fine plastics gauze. A series of electrolyses was performed at current densities varying from 2,000–6,000 A/m$^2$ and solution concentrations of 10–25 g/l zinc (as oxide). The results of these electrolyses are presented in Table V. Current efficiencies in excess of 80% were achieved in all cases, giving energy consumptions in the range 2.5–3.4 kWh/kg.

TABLE V

| Cell Current (Amps) | Cell Current Density (A/m$^2$) | Cell Voltage (V) | Solution Concn. (g/l) | Current Efficiency (%) | Overall Energy Consumption (kWh/kg) |
|---|---|---|---|---|---|
| 36 | 3000 | 2.8 | 15.33 | — | — |
| | | | 11.43 | 95 | 2.52 |
| 24 | 1800 | 2.65 | 25.9 | — | — |
| | | | 24.35 | 84.5 | — |
| | | | 21.06 | 82 | 2.76 |
| 40 | 5000 | 3.2 | 25.4 | — | — |
| | | | 19.5 | 88 | 3.1 |
| 50 | 3700 | 3.03 | 20.86 | — | — |
| | | | 18.3 | 89 | 2.91 |
| 60 | 5000 | 3.2 | 20.2 | — | — |
| | | | 18.6 | 92.5 | — |
| | | | 16.0 | 89 | 3.07 |
| 72 | 5330 | 3.6 | 24.6 | — | — |
| | | | 20.0 | 90.5 | 3.4 |

EXPERIMENT 10

Zinc Deposition from Sulphate Solution

The cation exchange membrane of the cell of FIG. 1 was replaced by an "Asahi" anion selective membrane to make provision for operating the electrolysis at a reasonably constant pH in the range 3–5.

The electrolysis of 50 g/l unacidified zinc solution down to 45 g/l was performed once at a cell current of 25 amps and once at 30 amps (7,000 and 8,500 A/m$^2$), at cell voltages of 5.8 and 7.3 respectively. The current efficiencies of the depositions were 61% and 60% respectively.

EXPERIMENT 11

Zinc Deposition from Chloride Solution

The results for deposition of zinc at 2,000 A/m$^2$ from the cell of FIG. 1 (mod) are given in Table VI, and show current efficiencies of around 60%. The current efficiency falls during the electrolysis, as pH falls, i.e. as $H^{30}$ ions arise from oxygen evolution at the anode. The diaphragm was an Ionac MC 3470 cation exchange membrane.

TABLE VI

| Cell Current (Amps) | Current Density (A/m$^2$) | Cell Voltage (V) | Electrolyte pH | Solution Concn. (g/l) | Current Efficiency Differential (%) |
|---|---|---|---|---|---|
| 20 | 2000 | 3.3 | 7 | 32.1 | — |
| | | | 2.05 | 29.1 | 64.5 |
| | | | 1.7 | 26.25 | 56 |

TABLE VI-continued

| Cell Current (Amps) | Current Density (A/m$^2$) | Cell Voltage (V) | Electrolyte pH | Solution Concn. (g/l) | Current Efficiency Differential (%) |
|---|---|---|---|---|---|
| | | | 1.6 | 25.4 | 54.5 |

EXPERIMENT 12

Cobalt Deposition

An anion exchange membrane was used in the cell of FIG. 1 instead of the cation exchange membrane to maintain the electrolyte pH within the range 2.0–4.0. The electrolyte was 30–50 g/l cobalt (as sulphate) plus 1 g/l manganese (as sulphate). The results of some prelimary electrolyses at 60° C. are given in Table VII. It can be seen that current efficiencies of over 50% are achieved at relatively low cobalt concentrations and high current densities. Current efficiencies are expected to be much higher with more concentrated solutions.

TABLE VII

| Diaphragm Manufacture | Cell Current (Amps) | Current Density (A/m$^2$) | Average Cell Voltage (V) | Electrolyte pH | Solution Concn. (g/l) | Current Effcy. |
|---|---|---|---|---|---|---|
| Ionac | 20 | 5700 | 11.0 | 3.2 | 48.2 | — |
| | | | | 2.4 | 45.8 | 55% |
| Ionac | 20 | 5700 | 11.0 | 4.8 | 38.1 | — |
| | | | | 2.4 | 33.1 | 50% |
| Asahi | 17 | 4850 | 5.5 | 4.6 | 45.9 | — |
| | | | | 2.4 | 43.2 | 51% |

EXPERIMENT 13

Manganese Deposition

An Ionac anion exchange membrane replaced the cation exchange membrane in the cell of FIG. 1. Preliminary investigations of this system confirmed that manganese could be deposited on the moving bed from solutions of low (10 g/l) manganese concentrations. An electrolysis at a higher (45 g/l) manganese concentration in 140 g/l ammonium sulphate (pH 7.5–8.5) indicated initial current efficiencies of greater than 60% at a current density of 2 500 A/m$^2$ and a cell voltage of 10 V. However the current efficiency could not be substantiated at longer electrolysis periods (over 2 hours) because an oxide of manganese precipitated in the electrolyte and manganese appeared to dissolve at the bottom of the cell and in the levitation region. Therefore we recommend the use of the cell of FIG. 1 (mod), by which all of the bed may be cathodically protected as all the levitation region is now in the vicinity of the cathode feeder.

As commercial manganese electrowinning is carried out in electrolyte solutions of greater purity than Analar grade, to use anything less than this in reproducing the present Experiment would not be a proper comparison.

We claim:

1. A method of moving bed electrolysis, in which a packed bed comprising conductive particles moves as a packed bed in an electrolyte between two electrodes and in electronic contact with one of said two electrodes, the particles emerging from a downstream end of the moving packed bed being transported, outside the electric field between the two electrodes, to a location from which substantially all of the particles join one of the moving packed bed at an upstream end and an upstream end of a succeeding moving packed bed between the electrodes.

2. A method according to claim 1, wherein the packed bed moves upwardly.

3. A method of moving bed electrolysis, in which a packed bed comprising conductive particles moves downward in a 'falling region' between two electrodes and in electronic contact with a first one of said two electrodes, and the particles emerging from the bottom of the moving packed bed are levitated, outside the electric field between the two electrodes, to a level above the top of one of the moving packed bed and a succeeding packed bed, whereafter substantially all of the particles drop into the space between the electrodes to join one of the moving packed bed and the succeeding packed bed.

4. A method according to claim 3, wherein the levitation is by introducing upwardly flowing electrolyte adjacent the bottom of the moving packed bed in a 'levitation region'.

5. A method according to claim 1 or claim 3, wherein the moving packed bed is constrained in all horizontal directions by rigid structure.

6. A method according to claim 5, wherein the rigid structure includes a diaphragm protecting a second one of said two electrodes with which the bed is not in electronic contact.

7. A method according to claim 1 or claim 3, wherein an electrolyte outlet is provided generally in the vicinity of the moving packed bed permitting electrolyte to flow co-current with the moving packed bed.

8. A method according to claim 7, wherein electrolyte is introduced into the electrolysis generally one of the adjacent and downstream as regards the particles from the electrolyte outlet.

9. A method according to claim 4, wherein one of said two electrodes, protected by a diaphragm separates the falling region from the levitation region.

10. A method according to claim 9, wherein said one electrode is disposed wholly within the falling region.

11. A method according to claim 10, wherein said one electrode is apertured and allows electrolyte to pass therethrough.

12. A method according to claim 11, wherein also particles pass therethrough.

13. A method according to claim 1 or claim 3, wherein a metal is being deposited from solution.

14. A method according to claim 13, wherein the metal is one of manganese, tin , zinc and cobalt.

* * * * *